United States Patent [19]

Heckathorne et al.

[11] 4,223,626

[45] Sep. 23, 1980

[54] SUPPORT FOR UNDERWATER MINE ANCHOR-LINE CUTTER

[75] Inventors: George E. Heckathorne, West Mifflin; Robert A. Bub, Gibsonia, both of Pa.

[73] Assignee: Mine Safety Appliances Company, Pittsburgh, Pa.

[21] Appl. No.: 1,873

[22] Filed: Jan. 8, 1979

[51] Int. Cl.[3] ..... B63B 9/00

[52] U.S. Cl. ..... 114/221 A; 24/134 R

[58] Field of Search ..... 114/221 R, 221 A, 244; 83/386; 24/134 R

[56] References Cited

U.S. PATENT DOCUMENTS

| | | | |
|---|---|---|---|
| 3,760,674 | 9/1973 | Temple | 114/221 A |
| 3,793,978 | 2/1974 | Temple et al. | 114/221 A |
| 4,040,376 | 8/1977 | Giebel | 114/221 A |

*Primary Examiner*—Edward R. Kazenske

*Assistant Examiner*—Jesùs D. Sotelo

*Attorney, Agent, or Firm*—Brown, Flick & Peckham

[57] ABSTRACT

A channel-shape sweep line retainer extends along the leading front edge of an elevating fin, with the open side of the retainer facing the trailing rear edge of the fin. Extending across the fin at the open side of the retainer is a bar mounted on the fin for movement toward and away from the retainer, but normally locked in its forward position by a pair of laterally spaced arms extending rearwardly away from the bar with their front ends engaging it. The rear ends of the arms are pivotally connected to the fin so that when arm-positioning spring means between the arms and connected to them are pulled rearwardly, the front ends of the arms will be swung inwardly toward each other out of engagement with the bar, whereupon the bar can be retracted to open the retainer for admission or release of a sweep line.

11 Claims, 2 Drawing Figures

2
21
14
9
3
4
23
19
18
22
6
12
7
22
8
15
14
16
17
10
9
28
II
II
1
27

24
15
14
17
22
10
9
22
8
4
3
2
18
11
5
1
27

SUPPORT FOR UNDERWATER MINE ANCHOR-LINE CUTTER

It is among the objects of this invention to provide a mine anchor-line cutter support which is an improvement upon the ones shown in U.S. Pat. Nos. 3,793,978 and 4,040,376, which reduces wear on the sweep line, which can be quickly applied to a sweep line in any position, which has improved reliability, which has full surface contact for the cable stop, which includes a dependable locking system for the sweep line, which can be quickly and easily applied to a sweep line using only one hand and with the cutter support either side up, and in which the moving parts are protected.

Figure 1:
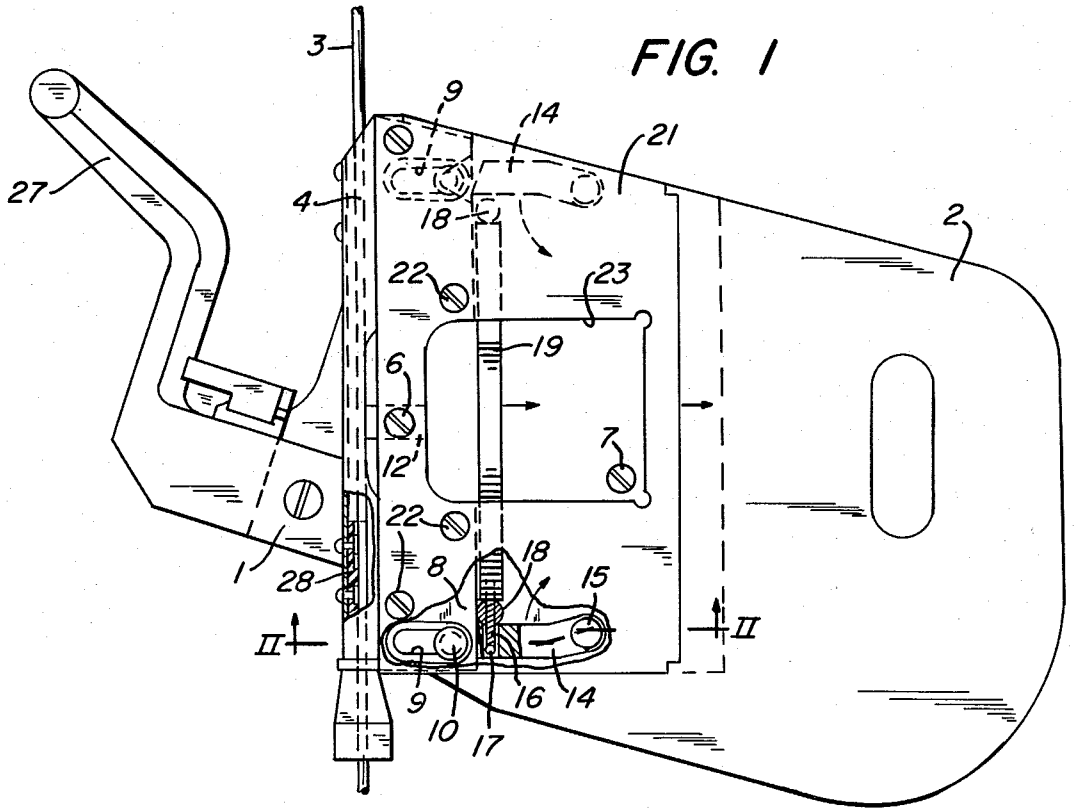
Figure 2:
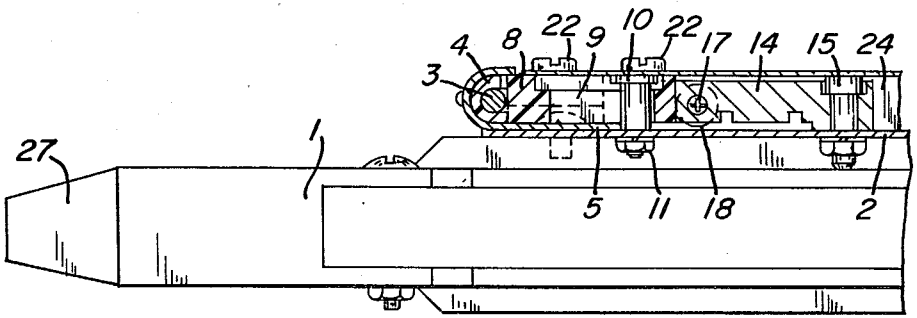

The preferred embodiment of the invention is illustrated in the accompanying drawings, in which FIG. 1 is a plan view, partly broken away in section; and FIG. 2 is an enlarged fragmentary cross section taken on the line II—II of FIG. 1.

Referring to the drawings, a holder for an underwater mine anchor-line cutter 1 includes an elevating fin 2 that can be drawn through a body of water by means of a sweep line 3 extending outwardly away from a mine sweeper (not shown) in a well known manner. The fin has a leading front edge and is disposed more or less horizontally as it is drawn through the water. To attach the fin to the sweep line, a channel-shape retainer 4 extends along the leading edge of the fin and has a rearwardly extending bottom flange 5 resting on top of the fin, where it is held in place by a shear screw 6 that extends down through the flange and fin and into the cutter to hold the cutter against the bottom of the fin. A second shear screw 7 farther back extends through only the fin and into the cutter. The open side of retainer 4 faces the trailing rear edge of the fin so that the retainer can be hooked over the sweep line.

In order to lock the fin on the sweep line, a bar 8, preferably made of a plastic, extends across the fin at the open side of the sweep line retainer. The bar extends the full length of the retainer and normally projects a short distance under its upper edge. The bar is mounted on the fin for movement torward and away from the retainer. Preferably, this is accomplished by providing the opposite end portions of the bar with slots 9 that extend part way across the narrow width of the bar. Extending up into these slots are pins 10, the lower ends of which are rigidly mounted in the fin by threading their lower ends and screwing nuts 11 onto them. The upper ends of the pins have heads overlapping the bar in the enlarged upper portions of the slots. The pins and slots permit the bar to be moved toward and away from the retainer, but prevent it from leaving the fin. Although the bar is mounted on the fin, it actually rests on retainer flange 5. Also, the bar is provided in its bottom with a groove 12 that receives the head of shear screw 6 so that the screw will not interfere with movements of the bar.

The bar is locked in its forward retainer-closing position by a pair of laterally spaced arms 14 that extend rearwardly away from the opposite ends of the bar. The front ends of the arms engage the bar and the rear ends are pivotally mounted on the fin by pivots 15. The arms are substantially parallel to each other while they are holding the bar in its forward position. Between the front ends of the arms there are spring means that are connected to them. The spring means include a tension spring, which may be either a coil spring 16 or an elastic cord, the ends of which extend into transverse bores in the arms, in which they are held by retaining pins 17. Encircling this spring beside each arm is a ball 18. The two balls are pressed outwardly against the arms by means of a coil spring 19 that encircles the first spring between the balls. The outer spring is under compression and its ends press outwardly against the two balls. When the springs are straight, as shown, they hold arms 14 in bar-locking position.

In order to retract the bar so that the retainer will be opened for receiving or releasing a sweep line, the central portion of the spring system is pulled toward the rear end of the fin. This causes the tension spring 16 to swing the front ends of arms 14 inwardly toward each other and away from the bar. The bar then can be retracted. To retract the released bar, a cover plate 21 overlies it and is rigidly connected to it by screws 22. The plate also extends rearwardly over the springs and pivoted arms. The central portion of the plate is provided with an opening 23 that extends both forward and backward from the springs. The portion of this opening in front of the springs registers with a recess in bar 8. This same portion of the opening and the bar recess allow a man's hand to grip the springs and pull them rearwardly as just mentioned. By the time the springs have moved the arms far enough to permit the bar to be fully retracted, the hand reaches the rear edge of plate opening 23, which forms a hand hold by which the plate can also be pulled back. This rearward movement of the plate pulls the bar back away from the sweep line retainer. When the central portion of the spring system is released, the springs will move forward and straighten, and this will cause the outwardly swinging arms 14 to move the bar forward again and lock it in its forward position, with its front edge extending a short distance into the retainer channel. The sides and back of the cover plate preferably are provided with side walls 24 that extend down into engagement with the fin to help prevent seaweed from fouling the mechanism. The side walls may be provided with openings, out through which sand can be flushed.

The anchor-line cutter 1 is provided with a hook 27 that projects forward from the fin for guiding the cutter onto an anchor-line and into a position where a trigger that fires the cutter in a well known manner will be actuated by the anchor-line. The specific construction of the cutter itself forms no part of this invention and therefore need not be described further.

By the use of a plastic bar 8 and plastic inserts 28 in the retainer 4, wear of the sweep line is eliminated. Since the bar slides on the fin, it is more stable and reliable than a pivoted locking device. It also is easy to replace if necessary.

The balls 18 eliminate erratic performance of the spring mechanism by ensuring a reliable return to the springs' normal straight-line configuration after they have been pulled to retract the bar. The cover plate 21 or guard restricts the spring movement in a predetermined path to the fully open position of the bar. The return movement of the springs is free.

One of the best features of this device is that it is so easy to apply to a sweep line with the use of only one hand. This is a great advantage in a tossing ship or on a rough sea, or in a bouncing helicopter. The cutter can be applied to either a right-hand or a left-hand sweep line, with the cutter right side up or upside down and with the sweep line extending at any angle.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A support for an underwater mine anchor-line cutter, the support comprising an elevating fin having top and bottom surfaces and a leading front edge, a channel-shape sweep line retainer above the fin extending along said leading edge and joined to the fin, the open side of said retainer facing the trailing rear edge of the fin for admitting a sweep line to the retainer, a bar extending across the fin at the open side of the retainer, means mounting the bar on the fin for movement toward and away from said retainer, a pair of laterally spaced arms normally extending rearwardly away from said bar with their front ends engaging it to lock it in its forward position closing the open side of the retainer, means pivotally connecting the rear ends of the arms to the fin, spring means between the arms and connected thereto for normally holding them in bar-locking position, the central portion of said spring means being adapted to be pulled rearwardly to swing the front ends of the arms inwardly toward each other out of engagement with said bar, and means for then retracting the bar to open said retainer for admission or release of a sweep line.

2. A support according to claim 1, in which said spring means include a tension spring having ends secured to said arms, a pair of balls between the arms in engagement therewith and encircling said spring, and a compression coil spring concentric with said tension spring and having ends engaging said balls and urging them away from each other.

3. A support according to claim 1, said mounting means for the bar including headed pins rigidly mounted in said fin and extending up into parallel slots in the bar.

4. A support according to claim 1, in which said bar is a plastic and extends the full length of said sweep line retainer.

5. A support according to claim 1, including a cover for said bar and arms and spring means, and means attaching the cover to the bar.

6. A support according to claim 5, in which said cover has depending side walls substantially engaging said fin.

7. A support according to claim 5, in which said cover is provided with a central opening for grasping said spring means to pull them rearwardly.

8. A support according to claim 7, in which the rear edge of said cover opening forms a hand hold for retracting the cover after said spring means have been pulled a predetermined distance.

9. A support according to claim 1, in which the upper edge of said sweep line retainer overlies the front portion of said bar when the bar is in its forward position.

10. A support according to claim 1, including an anchorline cutter engaging the bottom of said fin, said bar being provided in its bottom with a groove extending across it from front to back, and a shear screw extending down through the fin for holding said cutter against the fin, said screw having a head disposed in said bar recess, whereby the screw head does not interfere with movements of the bar on the fin.

11. A support according to claim 10, in which said sweep line retainer has a flange engaging the fin beneath the bar, and said shear screw extends through said flange to join it to the fin.

* * * * *